United States Patent [19]

Ashida et al.

[11] 4,294,189

[45] Oct. 13, 1981

[54] APPARATUS FOR COATING WIRES WITH PAINT

[75] Inventors: Hiroshi Ashida; Fumitake Takahashi, both of Nagoya, Japan

[73] Assignee: Sumitomo Electric Industries, Ltd., Osaka, Japan

[21] Appl. No.: 125,053

[22] Filed: Feb. 27, 1980

[30] Foreign Application Priority Data

Mar. 19, 1979 [JP] Japan ..... 54-31999

[51] Int. Cl.[3] ..... B05C 3/12

[52] U.S. Cl. ..... 118/603; 118/125; 118/405; 427/345; 427/358; 427/434.7

[58] Field of Search ..... 118/405, DIG. 18, 125, 118/602, 420, 603; 427/356–358, 434.7, 345; 164/174

[56] References Cited

U.S. PATENT DOCUMENTS 2,366,077 12/1944 Wildy et al. ..... 118/405 X
2,787,980 4/1957 McDermott ..... 118/420 X
3,346,413 10/1967 Lindemann ..... 118/405 X
3,574,665 4/1971 Basche ..... 427/358
4,130,676 12/1978 Ichiyanagi et al. ..... 427/358

*Primary Examiner*—Ralph S. Wendall
*Attorney, Agent, or Firm*—Sughrue, Mion, Zinn, Macpeak and Seas

[57] ABSTRACT

An apparatus for coating vertically extending wires with paint in which the temperature of a paint bath is accurately maintained and temperature variations within the bath are largely eliminated so as to provide constant coating characteristics. Vertically extending coating chambers are provided having relatively small cross-sectional areas so that heat generated by an adjacent heating element is spread evenly throughout the paint bath. A coating die is disposed at the top of each chamber. A discharge element is provided near the coating die and a paint receiving pool is stationed to receive the paint discharged through the outlet. The paint pool is in fluid communication with the bottom portion of each of the chambers.

5 Claims, 9 Drawing Figures

APPARATUS FOR COATING WIRES WITH PAINT

BACKGROUND OF THE INVENTION

The present invention relates to an improved apparatus for accurately coating with paint a number of wires which extend vertically upwardly.

In a conventional technique for coating vertically extending wires with paint, as shown in FIG. 1, a paint bath 2 having plural holes 3 at the bottom thereof is filled with paint 1. Wires 4 are inserted into the holes 3 running through coating dies 5 which maintain the thickness of the paint at a predetermined thickness. Coating dies 5 are held in place above the surface of the paint by a die holder 6. In order to maintain the temperature of the paint unchanged, a heater 7 may be provided which is built into the wall of the paint bath or a heater 7' may be provided inside of the paint bath as shown in FIG. 2.

However, in the conventional technique, the distance between the wire and the heating wall or the heating element is relatively large making the heating inefficient and the paint temperature variations in the paint bath too high.

Accordingly, an object of this invention is to provide a coating apparatus in which the above-described difficulties accompanying the conventional technique have been eliminated.

SUMMARY OF THE INVENTION

This, as well as other objects of the invention, are met by an apparatus for coating wires with paint including at least one chamber for holding paint to be applied to the wires and which is adapted for the wires to pass therethrough. A discharge outlet is provided in each of the chambers to allow paint to be discharged from the upper portion of each of the chambers. A coating die is disposed in the upper portion of each chamber. A paint pool holding means is provided for receiving paint which was discharged from the aperture in each of the chambers. The paint pool holding means is located outside the chambers and below the paint dies and is in fluid communication with a lower portion of each of the chambers. The discharge outlet in one embodiment in a gap provided between each of the paint dies and a wall of the corresponding chambers. In another embodiment, the discharge outlet may be an aperture formed in the upper portion of each chamber. The discharge outlet may include both an aperture formed in the upper portion of each chamber and a gap provided between each paint die and a wall of the corresponding chamber. There may also be provided a filter for cleansing paint discharged through the discharge outlet. The filter is positioned so that paint exiting the filter passes to the lower portion of each of the chambers. The cross-sectional area of each chamber is preferably sufficiently small so that the temperature gradient of paint within each chamber is small, that is the temperature variations of the paint within each chamber are sufficiently small as to not affect the coating characteristics of the paint being coated onto the wire.

BRIEF DESCRIPTION OF THE DRAWINGS

FIG. 3B is an enlarged view showing a die and its related components of FIG. 3A, FIG. 3C is a cross-sectional view taken along the line A—A of FIG. 3B, and FIG. 3D is a cross-sectional view taken along the line B—B in FIG. 3A;

DESCRIPTION OF THE PREFERRED EMBODIMENTS

Figure 1:
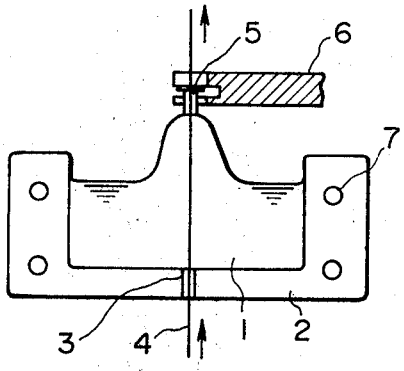
FIG. 1 PRIOR ART
FIGS. 1 and 2 are sectional views of conventional apparatuses for coating wires with paint.
Figure 2:
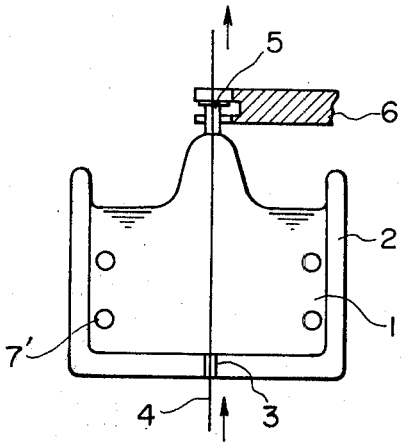
FIG. 2 PRIOR ART
Figure 3A:
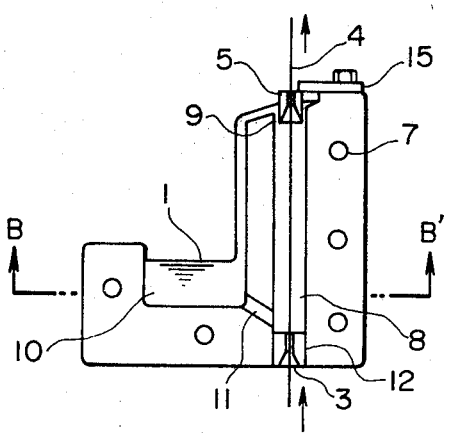
FIGS. 3A–3D are a series of cross-sectional views showing a first embodiment of an apparatus for painting wires constructed in accordance with the present invention. Specifically, in FIG. 3A is shown a cross-sectional view showing the entire coating apparatus.
Figure 3B:
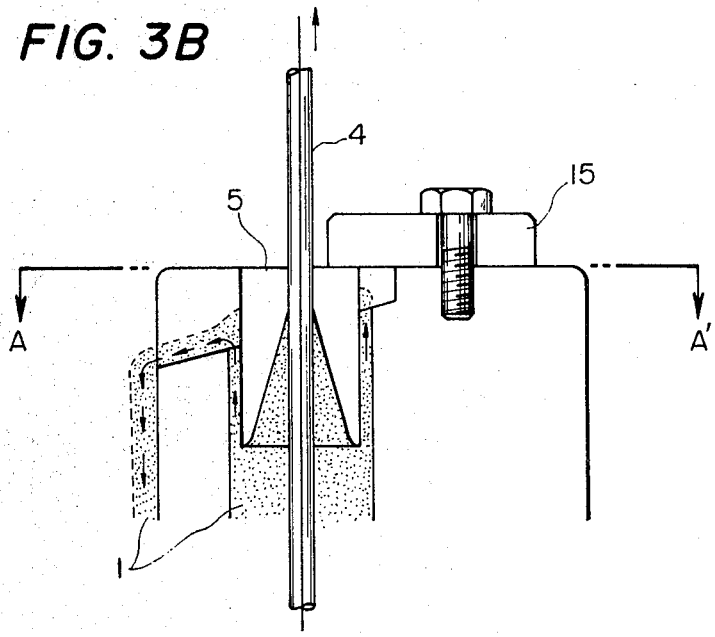
Figure 3C:
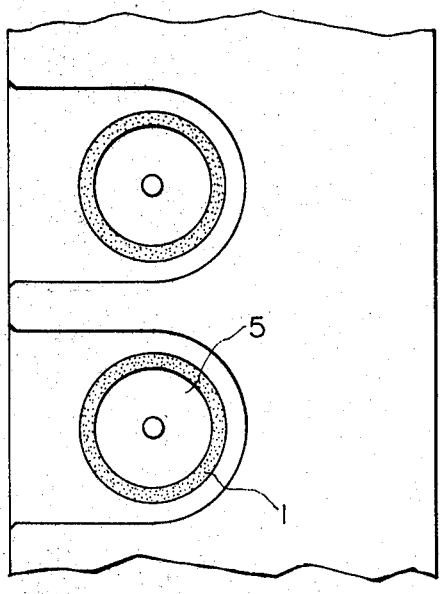
Figure 3D:
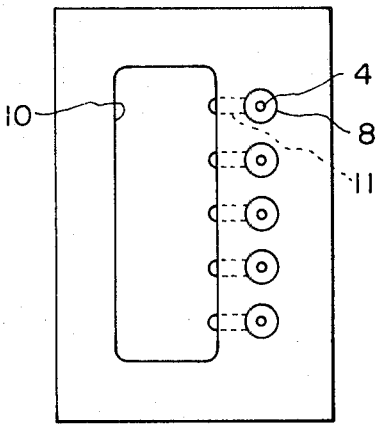

The invention will be described with reference to its preferred embodiments shown in FIGS. 3 through 5. However, it should be noted that the invention is not limited thereto or thereby.

In the embodiment shown in FIGS. 3A–3D, chambers 8 are provided through which the wires extend with coating dies 5 provided in the upper portions thereof. In order to allow the paint to flow out of the upper portion of each chamber, there is provided a gap 9 between the coating die 5 and the chamber 8. In order to receive and the store paint flowing out of the upper portion of the chamber 8, a paint pool 10 is provided outside the chamber at a level between the upper and lower portions of the chamber, that is, at a level below the coating die and above the lower portion of the chamber. The paint 1 in the paint pool 10 is allowed to flow into the lower portion of the chamber 8 through a communication hole 11. In FIGS. 3A–3D, reference numeral 7 designates heaters, 12 is a plug for the lower portion of each chamber, and 15 is a die stopper.

Figure 4:
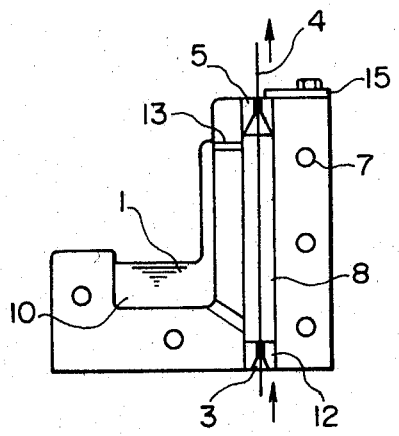
FIG. 4 is a cross-sectional view similar to FIG. 3A showing a second embodiment of the invention.

In another embodiment of a coating apparatus of the invention as shown in FIG. 4, the coating dies 5 are fitted into the upper portions of the chambers. Instead of the gaps 9 in the embodiment of FIGS. 3A–3D paint discharge holes 13 are formed below the dies 5 in order to allow the paint to flow out of the upper portion of the chambers similar to the case of FIGS. 3A–3D.

In the coating apparatus according to the invention, chambers 8 having a small cross-sectional area are provided for the wires to be coated with paint. Therefore, the heating efficiency is improved and the temperature of the paint in each chamber can be accurately maintained without large variations over different portions of the bath. Accordingly, even when the ambient temperature is very low, the coating operation can be stably carried out by simply increasing the length of the chambers.

With the coating apparatus of the invention arranged as described above, even if the length of the chambers is increased, the overall size of the apparatus is still small and compact and the coating operation may be satisfactorily carried out.

During the coating operation, if foreign matter is caught up by running wires for some reason, in the conventional coating apparatus the foreign matter from even a single wire may diffuse into the paint in the paint bath whereas, in the coating apparatus of the invention, foreign matter on the wire does not affect the other chambers other than the chamber of that particular wire because separate chambers are provided for each wire.

Furthermore, as the paint flows out of the upper portion of the chambers, any foreign matter can be extracted.

Figure 5:
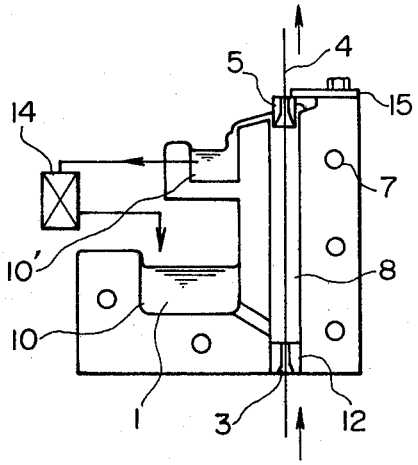
FIG. 5 is a cross-sectional view similar to FIG. 3A showing a third embodiment of the invention.

The paint 1 flowing out of the chambers may be passed through a filter 14 as shown in FIG. 5 so that clean paint is supplied to the lower portions of the chambers at all times, which further makes it possible to stably coat the wires.

In FIG. 5, reference numeral 10' designates an intermediate or auxiliary paint pool. Furthermore, in FIG. 5, those components which have been described with reference to FIG. 3 are similarly numbered. It goes without saying that in the coating apparatus shown in FIG. 5, instead of the gap 9, a discharge hole 13 may be employed as in the coating apparatus shown in FIG. 4.

Figure 6:
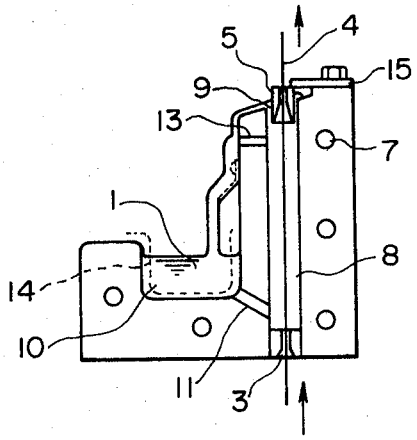
FIG. 6 is a cross-sectional view similar to FIG. 3A showing a fourth embodiment of the invention.

Still another embodiment is shown in FIG. 6 wherein a discharge hole 13 is formed at the upper portion of a chamber 8 and a gap 9 is provided between a coating die 5 and the chamber wall in order to allow the paint to flow out of the upper portion of the chamber. The paint thus flowing out of the chamber 8 is purified through a filter 14 positioned in the paint pool, and then flows into the chamber 8 through a communication hole 11.

What is claimed is:

1. An apparatus for coating wires with paint comprising: at least one chamber for holding paint to be applied to said wires and adapted for said wires to pass therethrough, a discharge outlet being provided in each said chamber for allowing said paint to be discharged from an upper portion of each chamber; a coating die disposed in said upper portion of each said chamber; paint pool holding means for receiving discharged paint from said aperture of each said chamber, said paint pool holding means being provided externally of, and laterally displaced from said chambers and below said paint dies, and said paint pool being in fluid communication with a lower portion of each said chamber, and wherein the cross-sectional area of each said chamber is sufficiently small such that the temperature gradient of the paint within each chamber is minimized.

2. The apparatus as claimed in claim 1, an inlet of said discharge outlet is formed as a gap provided between each said paint die in said upper portion of each said chamber and a wall of said chamber.

3. The apparatus as claimed in claim 1 wherein said discharge outlet is an aperture formed in said upper portion of each chamber.

4. The apparatus as claimed in claim 1 wherein said discharge outlet includes an aperture formed in said upper portion of each said chamber and a gap provided between each said paint die in said upper portion of each said chamber and a wall of said chamber.

5. The apparatus as claimed in claim 1 further comprising a filter for cleansing said discharged paint, said filter being positioned so that paint exiting said filter passes to said lower portion of each said chamber.

* * * * *